US007942647B2

(12) United States Patent
Okumura et al.

(10) Patent No.: US 7,942,647 B2
(45) Date of Patent: May 17, 2011

(54) PUMP FOR SUPPLYING CHEMICAL LIQUIDS

(75) Inventors: Katsuya Okumura, Tokyo (JP); Shigenobu Itoh, Komaki (JP); Kazuhiro Sugata, Komaki (JP); Kazuhiro Arakawa, Komaki (JP)

(73) Assignees: Octec Inc., Tokyo (JP); CKD Corporation, Komaki-Shi (JP)

( * ) Notice: Subject to any disclaimer, the term of this patent is extended or adjusted under 35 U.S.C. 154(b) by 473 days.

(21) Appl. No.: 11/665,983

(22) PCT Filed: Sep. 26, 2005

(86) PCT No.: PCT/JP2005/017579

§ 371 (c)(1),
(2), (4) Date: Apr. 20, 2007

(87) PCT Pub. No.: WO2006/048980

PCT Pub. Date: May 11, 2006

(65) Prior Publication Data

US 2008/0089794 A1 Apr. 17, 2008

(30) Foreign Application Priority Data

Nov. 1, 2004 (JP) ..... 2004-317576

(51) Int. Cl.
*F04B 45/00* (2006.01)
*F04B 43/06* (2006.01)

(52) U.S. Cl. ..... 417/395; 417/413.1

(58) Field of Classification Search ..... 417/395, 417/413.1

See application file for complete search history.

(56) References Cited

U.S. PATENT DOCUMENTS

| | | | | | |
|---|---|---|---|---|---|
| 2,311,229 | A | * | 2/1943 | Herbert | 417/395 |
| 2,843,050 | A | * | 7/1958 | Harper | 417/317 |
| 3,508,848 | A | * | 4/1970 | Schmidlin | 417/395 |
| 3,661,060 | A | * | 5/1972 | Bowen | 92/102 |
| 3,668,978 | A | * | 6/1972 | Bowen | 92/98 R |
| 3,955,901 | A | * | 5/1976 | Hamilton | 417/395 |
| 4,135,496 | A | * | 1/1979 | Chazov et al. | 600/17 |
| 4,624,625 | A | * | 11/1986 | Schrenker | 417/20 |
| 4,634,430 | A | * | 1/1987 | Polaschegg | 604/141 |
| 4,741,678 | A | * | 5/1988 | Nehring | 417/395 |
| 4,755,111 | A | * | 7/1988 | Cocchi et al. | 417/394 |

(Continued)

FOREIGN PATENT DOCUMENTS

JP U 55-161078 11/1980

(Continued)

*Primary Examiner* — Devon C. Kramer
*Assistant Examiner* — Amene S Bayou
(74) *Attorney, Agent, or Firm* — Oliff & Berridge, PLC

(57) ABSTRACT

An opening 22*d* of a supply/withdrawal passage 22*b* is positioned at the center part of the internal wall surface 22*c* of the operating chamber 26 (concave area 22*a*), and a pin 24 that protrudes toward the diaphragm 23 is provided in a position that is offset from the center of the wall surface 22*c*. When the diaphragm 23 is deformed toward the operating chamber 26 by the suction of an operation air into the operating chamber 26 during drawing in the chemical liquid, a part of the diaphragm 23 opposing to the pin 24 rides on the pin 24 and this part becomes a slightly convex shape toward the pump chamber 25. When the operation air is supplied from the opening 22*d* into the operating chamber 26 during the discharge of the chemical liquid, the deformation begins first from the part of the diaphragm 23 riding on the pin 24.

6 Claims, 10 Drawing Sheets

U.S. PATENT DOCUMENTS

| | | | | | |
|---|---|---|---|---|---|
| 4,915,017 | A | * | 4/1990 | Perlov | 92/5 R |
| 5,088,515 | A | * | 2/1992 | Kamen | 137/15.17 |
| 5,252,041 | A | * | 10/1993 | Schumack | 417/395 |
| 5,902,096 | A | * | 5/1999 | Behringer et al. | 417/395 |
| 6,132,187 | A | * | 10/2000 | Ericson | 417/486 |
| 2005/0074340 | A1 | * | 4/2005 | Xu et al. | 417/395 |

FOREIGN PATENT DOCUMENTS

| | | |
|---|---|---|
| JP | Y2 60-15130 | 5/1985 |
| JP | A 64-29267 | 1/1989 |
| JP | A 64-51764 | 3/1989 |
| JP | A 6-2665 | 1/1994 |
| JP | A 6-221269 | 8/1994 |
| JP | A 7-269466 | 10/1995 |
| JP | A 7-269467 | 10/1995 |
| JP | A 11-343978 | 12/1999 |
| JP | A 2003-49778 | 2/2003 |
| JP | A 2003-129962 | 5/2003 |
| JP | A 2006-77712 | 3/2006 |
| JP | A 2006-125338 | 5/2006 |

* cited by examiner

PUMP FOR SUPPLYING CHEMICAL LIQUIDS

TECHNICAL FIELD

The present invention relates to a pump for supplying chemical liquids that is suitable for applying a predetermined volume of a chemical liquid, such as a photoresist liquid, to individual semiconductor wafers in the chemical-using process of, for example, a semiconductor manufacturing device.

BACKGROUND ART

In order to pump a chemical liquid such as a photoresist out of a bottle and apply a predetermined volume of this liquid to individual semiconductor wafers, a pump for supplying chemical liquids such as that disclosed in Patent Document 1, for example, is currently in use. This pump is divided by a diaphragm into a pump chamber and an operating chamber (a pressurization chamber in Patent Document 1), and driving the diaphragm by supplying air to or withdrawing air from the operating chamber, via a supply/withdrawal passage connected to the operating chamber, changes the volume inside the pump chamber, thereby causing the pump chamber to suction or discharge a chemical liquid.

A pump has been available that is made thin by forming its pump chamber and operating chamber to be thin and using a diaphragm comprised of a flexible film. In such a pump, the diaphragm is secured at its periphery, and consequently, during the manufacturing of the diaphragm, the area located inside the secured periphery (partitioning area) ends up being formed curved in a slight convex shape toward either the pump or the operating chamber. As a result, the diaphragm does not have any tensile force (or has only a small amount of tensile force) in the region between the position at which the diaphragm would naturally curve toward the operating chamber and the position at which the diaphragm would naturally curve toward the pump chamber.

In a pump such as that described above, the opening of the supply/withdrawal passage in the operating chamber is normally positioned at the center of the operating chamber. Therefore, during the discharging of a chemical liquid, the operating air, supplied from the supply/withdrawal passage to the operating chamber, applies a well-balanced pressing force over the entire partitioning area of the diaphragm, causing the partitioning area to begin to slightly deform starting at its center. Initially, the entire partitioning area withstands the pressing force from the operating air and remains on the operating chamber side, but when its threshold is exceeded, the entire partitioning area deforms toward the pump chamber all at once, reaching the boundary of the region in which tensile force does not occur (the boundary on the pump chamber side).

During the discharging of a chemical liquid, when the entire partitioning area of the diaphragm all at once deforms toward the boundary of the region where tensile force does not occur (the boundary on the pump chamber side), the operating force applied to the diaphragm changes (increases) rapidly. During this phenomenon, the volume of the operating chamber increases rapidly, rapidly reducing the pressure inside the operating chamber. This causes a phenomenon in which the diaphragm is pulled back toward the operating chamber, with the result that the discharging pressure pulsates, making the discharging of the chemical liquid problematically unstable. Furthermore, since the operating force applied to the diaphragm changes (increases) rapidly, it has been difficult to precisely control the discharging pressure.

Patent document 1: Japanese patent application publication No. 2003-49778

DISCLOSURE OF THE INVENTION

A primary object of the present invention is to provide a pump for supplying chemical liquids that stabilizes the discharging of chemical liquids by reducing the pulsation of the discharging pressure caused by a diaphragm and that can precisely control the discharging pressure.

A first pump for supplying chemical liquids according to the present teaching is configured as described below. That is, in a pump for supplying chemical liquids in which the pump chamber and operating chamber are divided by means of a diaphragm comprised of a flexible film, the diaphragm deforms toward the pump chamber when the interior of the operating chamber is pressurized using an operating gas, thereby discharging the chemical liquid that has been supplied into the pump chamber; and when the interior of the operating chamber reaches a negative pressure due to the withdrawal of the operating gas or when the interior of the operating chamber is opened to the surrounding atmosphere, the diaphragm deforms toward the operating chamber, thereby drawing the chemical liquid into the pump chamber, and a supply/withdrawal passage for supplying the operating gas to or withdrawing same from the operating chamber is formed in a pump housing, and an opening of the supply/withdrawal passage on the internal wall surface of the operating chamber is positioned in the center of the internal wall surface, and a protruding area that protrudes toward the diaphragm is provided in a position that is offset from the center of the internal wall surface of the operating chamber.

In this pump for supplying chemical liquids, the opening of the supply/withdrawal passage is provided in the center of the internal wall surface of the operating chamber, and a protruding area that protrudes toward the diaphragm is provided in a position that is offset from the center of the internal wall surface. Therefore, during the suctioning of the chemical liquid, when the operating gas inside the operating chamber is evacuated (sucked out) and the diaphragm deforms toward the operating chamber, the part of the diaphragm corresponding to the protruding area rides on the protruding area and the diaphragm becomes curved in a slightly convex shape toward the pump chamber. Then, during the discharging of the chemical liquid, when the operating air is supplied from the opening of the supply/withdrawal passage into the operating chamber, the diaphragm begins to deform first from the area that is riding on the protruding area (the area that is offset from the center) and the deformation spreads gradually. In other words, the diaphragm does not deform all at once.

Here, when the diaphragm is formed to be curved in a slightly convex shape toward either the pump chamber or operating chamber, the diaphragm in its natural state does not have any tensile force (or has only a small amount of tensile force) between the position at which it is convex toward the operating chamber and the position at which it is convex toward the pump chamber. In this case, if there is no protruding area, the diaphragm begins to deform from its center little by little, and after reaching the threshhold at which the diaphragm can no longer withstand the pressure from the operating gas, the entire diaphragm deforms all at once toward the boundary of the region in which tensile force does not occur (the boundary on the pump chamber side). In contrast, if a protruding area is provided, the diaphragm smoothly deforms from the area riding on the protruding area (the area that is offset from the center) to its surrounding area, and thus the diaphragm does not deform all at once. Consequently, the operating pressure changes gradually, and there is neither a sudden increase in the volume of the operating chamber nor an associated rapid pressure drop. As a result, the distance by which the diaphragm is pulled back toward the operating chamber becomes extremely small, reducing the pulsation of the discharging pressure, and thus stabilizing the discharging of the chemical liquid. Moreover, the fact that the change in the operating pressure applied to the diaphragm is gradual makes it possible to precisely control the discharging pressure.

Note that the aforementioned protruding area can be formed by installing a protruding member on the internal wall surface of the operating chamber or integrally with the internal wall surface of the operating chamber, for example, as described below.

In the chemical liquid supply pump, the protruding area is provided on the internal wall surface of the operating chamber. However, it is also possible to provide a protruding area on the internal wall surface of the pump chamber at a position that is offset from its center such that the protruding area contacts the diaphragm before the diaphragm deforms to the position that causes the discharging pressure to pulsate. With such a configuration, because the diaphragm contacts the protruding area, its deformation is gradually suppressed from the position that is offset from the center of the diaphragm. Therefore, as with the chemical liquid supply pump described above, this results in a gradual change in the operating pressure applied to the diaphragm, a gradual increase in the volume of the operating chamber, as well as stable discharging of the chemical liquid, and makes it possible to precisely control the discharging pressure. However, providing a protruding area in the pump chamber would not be desirable since it would not only interfere with the flow of the chemical liquid, but could also cause stagnation in the chemical liquid. Therefore, it is desirable to provide the protruding area on the internal wall surface of the operating chamber as in the chemical liquid supply pump described above.

In a preferred embodiment of the chemical liquid supply pump, an installation hole can be provided at a position that is offset from the center of the internal wall surface of the operating chamber, and the protruding area can be configured by inserting a protruding member into the installation hole.

In this configuration, the installation hole is formed at a position that is offset from the center of the internal wall surface of the operating chamber, and the protruding area is configured by inserting a protruding member into the installation hole. That is, all that is required for configuring the protruding area is the formation of the installation hole on the internal wall surface of the operating chamber. Therefore, forming the internal wall surface of the operating chamber becomes simpler, especially when machining is used to form the operating chamber, than integrally forming the protruding area with the internal wall surface.

In both of the aforementioned configurations, the height by which the protruding area protrudes from the internal wall surface of the operating chamber should preferably be set shorter than the distance from the internal wall surface to the middle position between the operating chamber and the pump chamber.

When the height by which the protruding area protrudes from the internal wall surface of the operating chamber is set shorter than the distance from the internal wall surface to the middle position between the operating chamber and the pump chamber in this way, the protruding area does not significantly interfere with the flow of chemical liquid inside the pump chamber.

In either of the aforementioned configurations, the protrusion height of the protruding area should preferably decrease continuously toward its periphery.

For example, if the protrusion height changes drastically in some part of the protruding area, or if the protrusion height from the internal wall surface of the operating chamber is relatively taller in the periphery of the protruding area, when the diaphragm deforms to the position of contacting the internal wall surface of the operating chamber during suctioning, it will bend significantly near the area where the protrusion height varies drastically, concentrating the stress in the bent area. When this state of concentrated stress is repeated through the discharging and suctioning actions of the pump, the density of the diaphragm in the bent area gradually decreases, making it easier for the resist liquid to penetrate the diaphragm, creating the risk that it will eventually leak into the operating chamber.

However, when the protrusion height of the protruding area decreases continuously toward its periphery, there is no area where the protrusion height changes drastically, and the protrusion height from the internal wall surface of the operating chamber is also smaller at the periphery. As a result, even when the diaphragm deforms to the position of contacting the internal wall surface of the operating chamber during suctioning, it will not bend significantly in any particular area and the stress will be distributed evenly, thus preventing damage to the diaphragm due to stress concentration.

Another pump for supplying chemical liquids according to the present invention can be configured as described below. That is, in a pump for supplying chemical liquids in which the pump chamber and operating chamber are divided by means of a diaphragm comprised of a flexible film, the diaphragm deforms toward the pump chamber when the interior of the pump chamber is pressurized using an operating gas, thereby discharging the chemical liquid that has been supplied into the pump chamber; and when the interior of the operating chamber reaches a negative pressure because of the withdrawal of the operating gas or when the interior of the operating chamber is opened to the surrounding atmosphere, the diaphragm deforms toward the operating chamber, thereby drawing a chemical liquid into the pump chamber; and a supply/withdrawal passage for supplying the operating gas to or withdrawing same from the operating chamber is formed in a pump housing, with an opening of the supply/withdrawal passage on the internal wall surface of the operating chamber located in a position that is offset from the center of the internal wall surface.

In this pump for supplying chemical liquids, the opening of the supply/withdrawal passage is provided in a position that is offset from the center of the internal wall surface of the operating chamber. Therefore, during the discharging of a chemical liquid, when the operating gas is supplied from the opening of the supply/withdrawal passage into the operating chamber, the diaphragm begins to deform first from the area that corresponds to the opening, and thus the entire diaphragm does not deform all at once, as was the case in the aforementioned chemical liquid supply pump. Consequently, the operating pressure applied to the diaphragm changes gradually, and there is neither a sudden increase in the volume of the operating chamber, nor an associated rapid pressure drop. As a result, the distance by which the diaphragm is pulled back toward the operating chamber becomes extremely small, reducing the pulsation of the discharging pressure, and thus stabilizing the discharging of the chemical liquid. Moreover, since the change in the operating pressure applied to the diaphragm is gradual, it becomes possible to precisely control the discharging pressure.

In either of the aforementioned configurations, the internal wall surface of the operating chamber should preferably be circular in shape.

In this configuration, the fact that the internal wall surface of the operating chamber is circular in shape allows the operating gas to be efficiently supplied to and evacuated from the operating chamber. The effect is especially large in the aforementioned first chemical liquid supply pump since the opening of the supply/withdrawal passage is provided in the center of such an internal wall surface.

In either of the aforementioned configurations, a venting groove that extends from the opening of the supply/withdrawal passage toward the periphery of the internal wall surface should preferably be formed on the internal wall surface of the operating chamber.

In this configuration, the venting groove, which extends from the opening of the supply/withdrawal passage toward the periphery of the internal wall surface, is formed on the internal wall surface of the operating chamber, and the venting groove connects to the opening. Therefore, during the suctioning of a chemical liquid, even when the diaphragm deforms from the center, thus covering the opening of the supply/withdrawal passage first, it is possible to continue to evacuate (draw out) the operating gas inside the operating chamber through the venting groove, which is positioned outside the center contacted first. This allows the diaphragm to deform sufficiently toward the operating chamber, preventing insufficient suctioning of the chemical liquid.

As will be explained below, when both the pump housing and the operating chamber are formed to be thin in the deformation direction of the diaphragm, the resulting structure tends to cause the center of the diaphragm to cover the opening of the supply/withdrawal passage first during the suctioning of a chemical liquid, and therefore the significance of providing the venting groove is great.

In either of the aforementioned configurations, the pump housing should preferably be formed to be thin in the deformation direction of the diaphragm.

In this configuration, since the pump housing is formed to be thin in the deformation direction of the diaphgram, the operating chamber must also be formed to be thin in the same direction. During the suctioning of a chemical liquid, the diaphragm is usually used in contact with the internal wall surface of the operating chamber in order to maximize the volume of chemical liquid to be suctioned, which becomes one of the factors that cause the entire diaphragm to deform all at once during the discharging of the chemical liquid. Therefore, the significance of making the diaphragm gradually deform from a position that is offset from its center is great.

EXPLANATION OF SYMBOLS

22 . . . pump housing; 22*b* . . . supply/withdrawal passage; 22*c* . . . internal wall surface; 22*d* . . . opening; 22*e* . . . installation hole; 22*f* . . . venting groove; 23 . . . diaphragm; 24 . . . pin (protruding area and protruding member); 25 . . . pump chamber; 26 . . . operating chamber; R . . . resist liquid (chemical liquid).

DESCRIPTION OF THE PREFERRED EMBODIMENT

An embodiment in which the present invention is implemented into the pump unit of a chemical liquid supply system used in a manufacturing line of a semiconductor device, etc. is explained below, referencing the drawings. Note that FIG. 1 and FIG. 2 illustrate a pump unit 10, which is a primary component of the system, while FIG. 3 illustrates the entire chemical liquid supply system.

Figure 1:
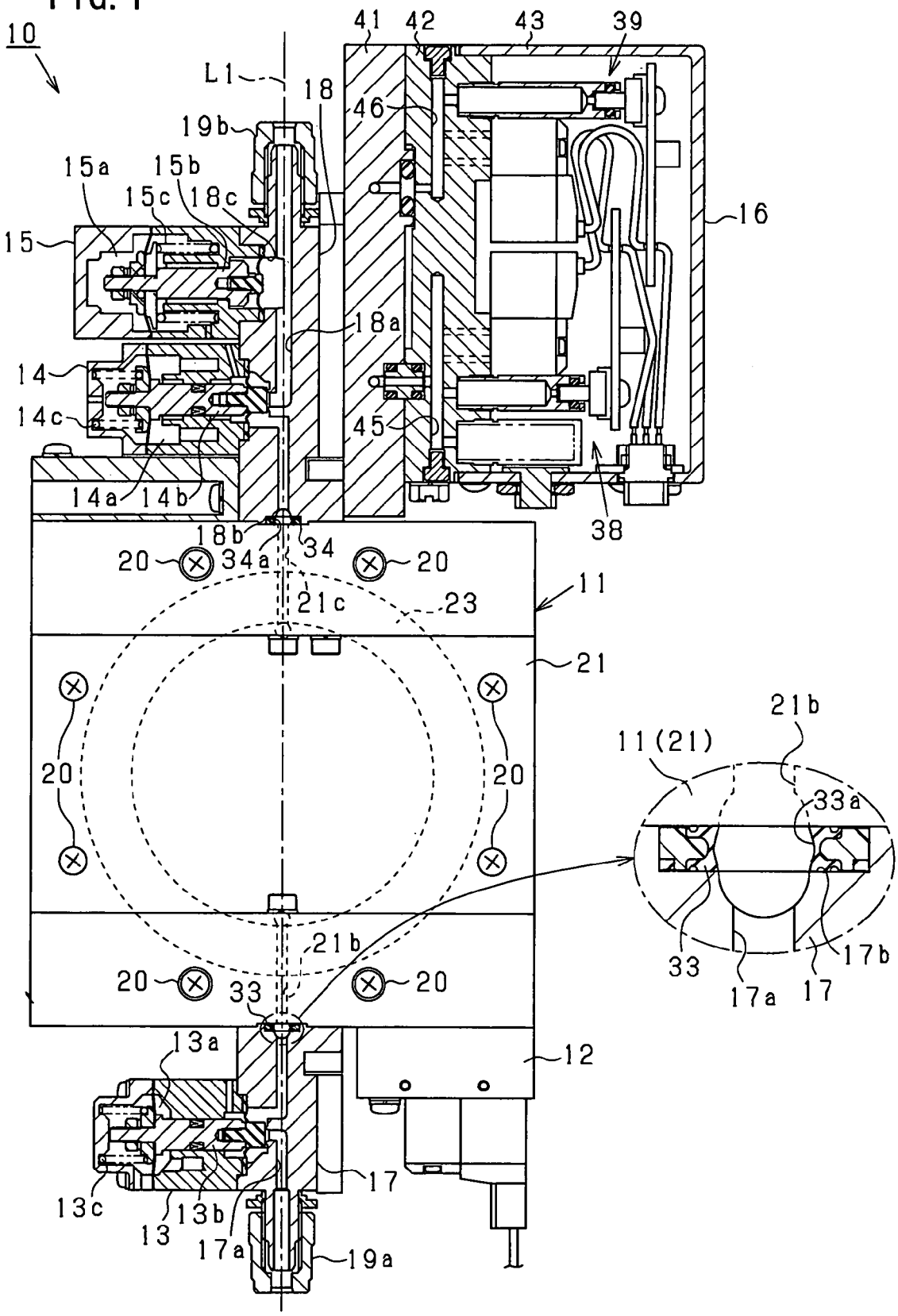
FIG. 1 is a frontal cross-sectional diagram illustrating the pump unit inside the chemical liquid supply system.
Figure 2:
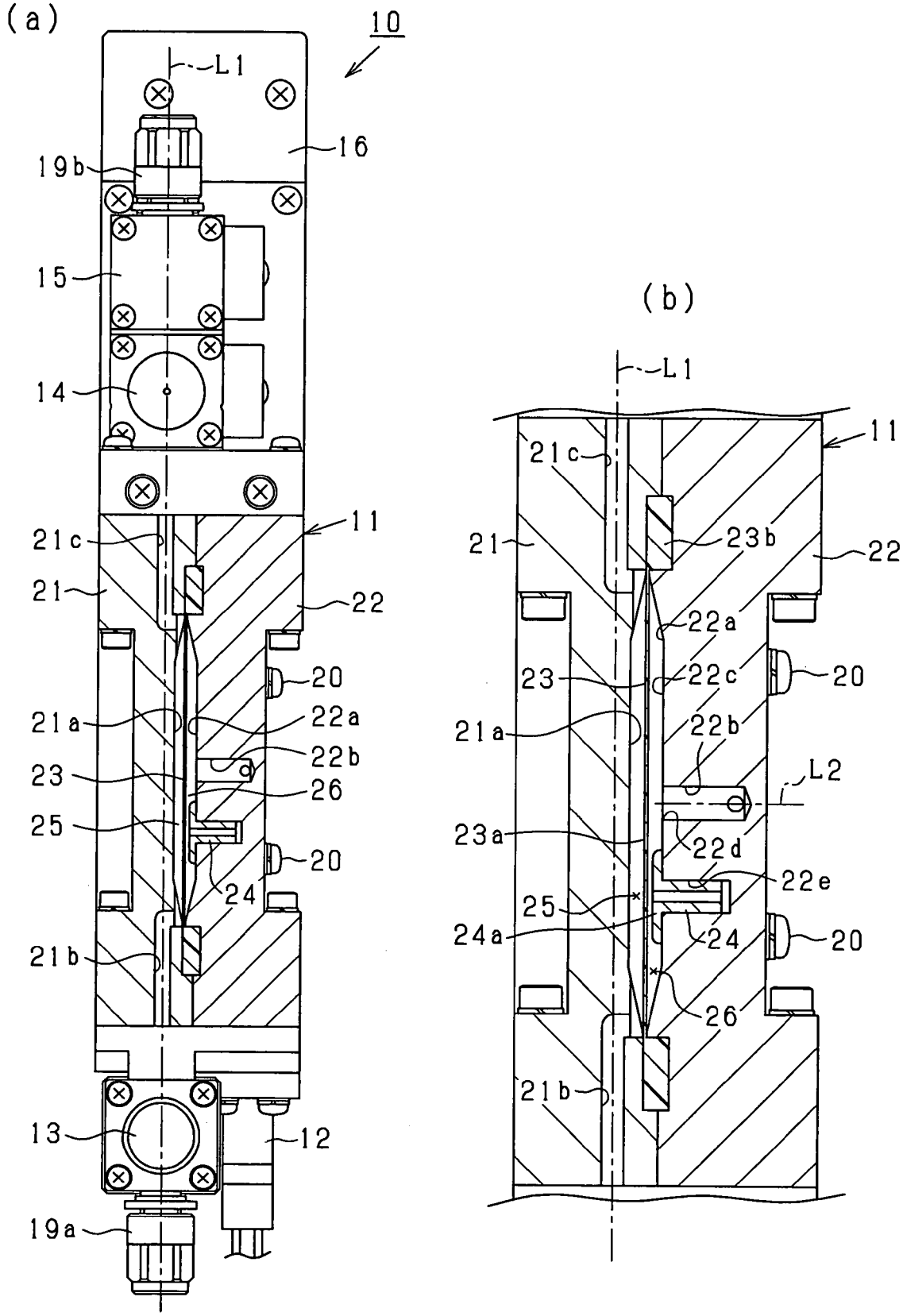
FIG. 2(*a*) is a side cross-sectional diagram of the pump unit, and (*b*) is an enlarged cross-sectional diagram of (*a*).
Figure 3:
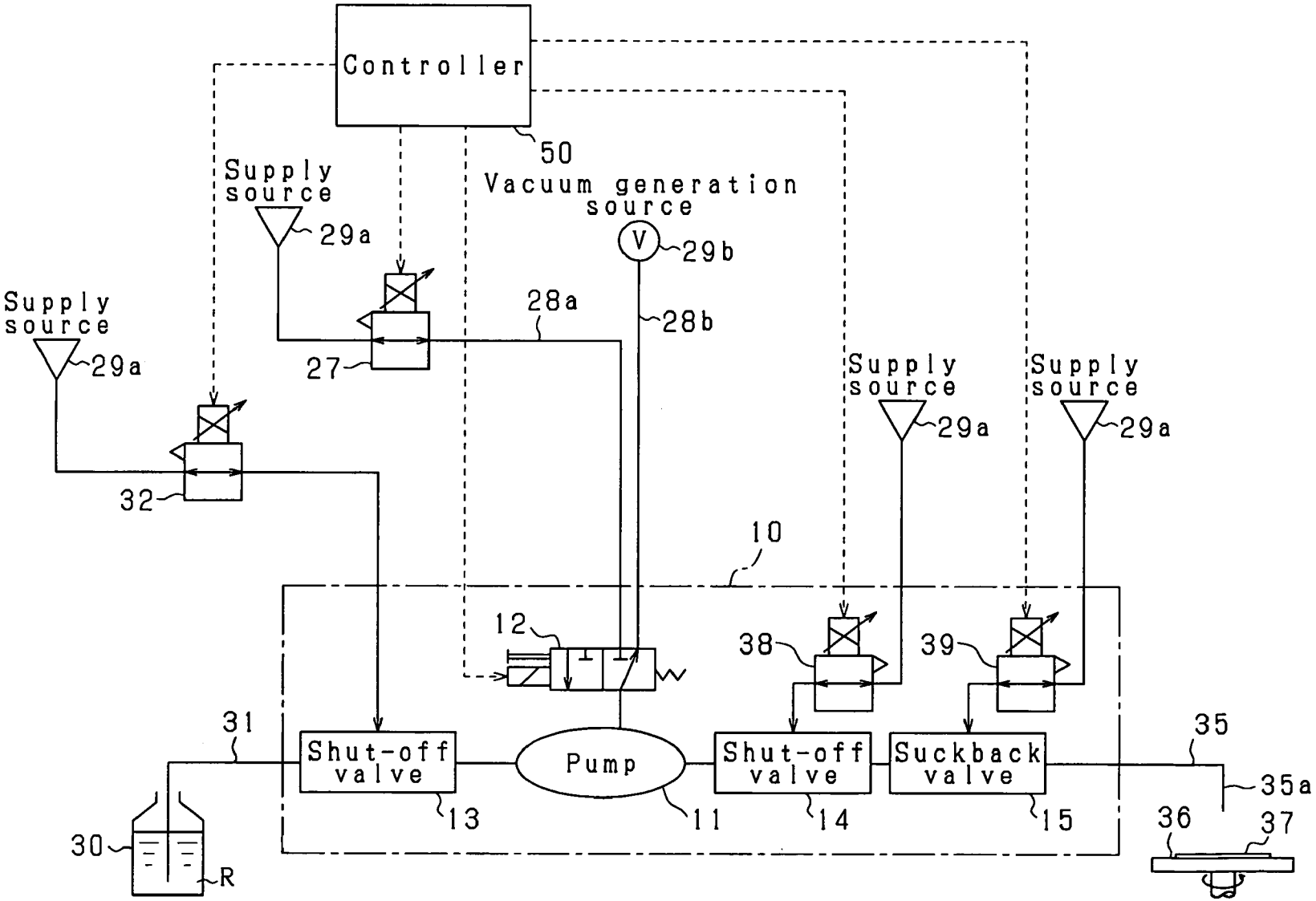
FIG. 3 is a circuit diagram illustrating the entire circuitry of the chemical liquid supply system.

As shown in FIG. 1 and FIG. 2, the pump unit 10 is formed by assembling together a pump 11, a solenoid switching valve 12, a suction-side shut-off valve 13, a discharge-side shut-off valve 14, a suckback valve 15, a regulator 16, a suction-side passage member 17 and a discharge-side passage member 18.

The pump 11 has a thin flat prism form having a nearly square shape when viewed from the front, and a pair of pump housings 21 and 22. Concave areas 21*a* and 22*a*, opened in almost circular dome shapes, are formed in the center of the opposing faces of pump housings 21 and 22, respectively. In the pump housings 21 and 22, the peripheries of the concave areas 21*a* and 22*a* hold and support a diaphragm 23 comprised of a circular flexible film made of a fluorine resin or the like, and the pump housings 21 and 22 are secured to each other using eight screws 24.

A diaphragm 23 partitions the space formed by the concave areas 21*a* and 22*a* of the pump housings 21 and 22, with the space on the side of pump housing 21 (the left side of the diaphragm 23 in FIG. 2) used as a pump chamber 25 and the space on the side of pump housing 22 (the right side of the diaphragm 23 in FIG. 2) used as an operating chamber 26. The pump chamber 25 is a space for supplying/withdrawing the resist liquid R (see FIG. 3) used as a chemical liquid, and the operating chamber 26 is a space for supplying/withdrawing the operating air for driving the diaphragm 23. Note that in order to reduce the thickness of the pump 11, the pump housings 21 and 22 are made thin (in this case in the deformation direction of the diaphragm 23), with the result that both the pump chamber 25 and the operating chamber 26 form thin spaces in the same direction.

A suction passage 21*b*, which is connected to the pump chamber 25 and extends linearly downward, is formed in pump housing 21 on the pump chamber 25 side. The suction passage 21*b* is connected to suction passage 17*a* of the suction-side passage member 17. A discharge passage 21*c*, which is connected to the pump chamber 25 and extends linearly upward, is also formed in pump housing 21. Furthermore, this discharge passage 21*c* is provided on the same line L1 as the suction passage 21*b*. Since the pump chamber 25 in this embodiment is formed as a thin space in the deformation direction of the diaphragm 23, the suction passage 21*b* and discharge passage 21*c* connected to this pump chamber 25 are bent perpendicularly near the pump chamber 25 to the degree necessary for connection (roughly equaling the width of the passage) (see FIG. 2). However, these bends do not significantly impact (create resistance to) the flow of the resist liquid R inside the pump 11, but allow the resist liquid R to flow smoothly in these areas.

A supply/withdrawal passage 22*b*, which supplies operating air to the operating chamber 26, is formed in the pump housing 22 on the operating chamber 26 side. An opening 22*d* of the supply/withdrawal passage 22*b* on the internal wall surface 22*c* of the operating chamber 26 (concave area 22*a*) is positioned in the center of the circular concave area 22*a* (indicated by the center line L2 in FIG. 2 and FIG. 4). The supply/withdrawal passage 22*b* is then connected to a solenoid switching valve 12 secured to the pump housing 22.

Figure 4:
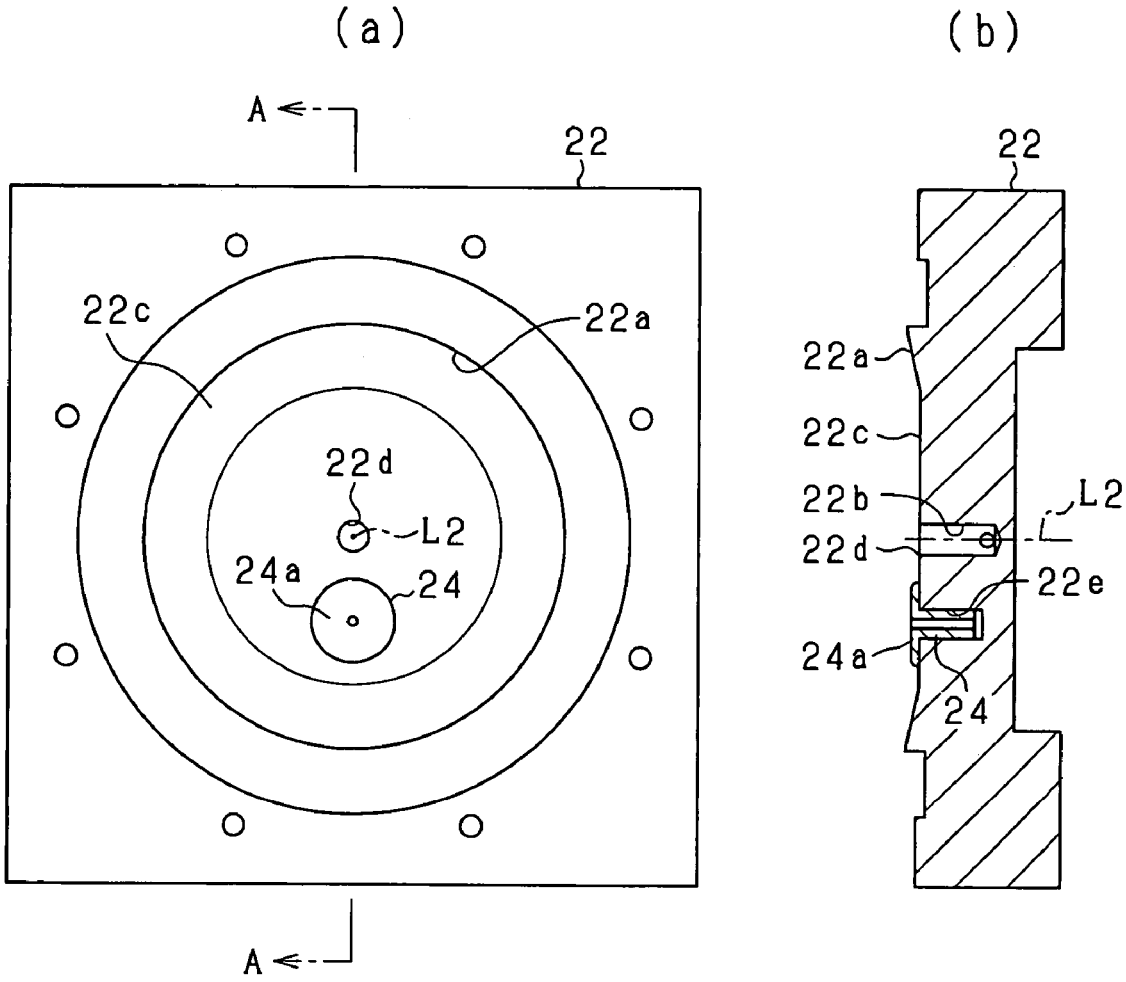
FIG. 4(*a*) is the front view of the pump housing on the operating chamber side, and (*b*) is a cross-sectional diagram along line A-A in (*a*).

Furthermore, as shown in FIG. 4, an installation hole 22*e* is formed on the internal wall surface 22*c* of the operating chamber 26 at a position that is offset from the center of the concave area 22*a* to the periphery side, and a pin 24 is press-fit into the installation hole 22*e*. The head 24*a* of the pin 24 protrudes from the internal wall surface 22*c* toward the diaphragm 23. The head 24*a* has a disk shape, and the corner of the periphery of its top surface is beveled. The protrusion height of the head 24*a* is set to be smaller than the distance from the internal wall surface 22*c* to the middle position between the operating chamber 26 and the pump chamber 25.

Here, the intake port of the solenoid switching valve 12 is connected to one end of a supply tube 28 as shown in FIG. 3. The supply tube 28 has an electro-pneumatic regulator 27 in the middle, and the other end of the supply tube 28 is connected to a supply source 29*a*. The electro-pneumatic regulator 27 is adjusted by a controller 50, such that the pressure of the operating air supplied from the supply source 29*a* to the pump 11 remains constant at a preset value. The exhaust port of the solenoid switching valve 12 is connected to a vacuum generation source 29*b* via an exhaust pipe 28*b*. The solenoid switching valve 12 is controlled and switched by the controller 50 to connect the operating chamber 26 to either the supply source 29*a* or the vacuum generation source 29*b*. This switching action either supplies operating air to or withdraws it from the operating chamber 26, thereby switching the pump 11 between suctioning and discharging actions.

That is, when the action of the solenoid switching valve 12 supplies operating air to the operating chamber 26, the interior of the operating chamber 26 is pressurized, pushing the diaphragm 23 to the pump chamber 25 side and discharging the resist liquid R contained inside the pump chamber 25 to the downstream side via the discharge passage 21*c*. In contrast, when the action of the solenoid switching valve 12 evacuates the operating air out of the operating chamber 26 and the pressure inside the operating chamber 26 becomes negative, the diaphragm 23, which has been pushed to the pump chamber 25 side, moves toward the operating chamber 26, introducing the resist liquid R from the upstream side into the pump chamber 25 via the suction passage 21*b*.

Here, the peripheral edge 23*b* of the diaphragm 23 is secured between the pump housings 21 and 22, and the interior of the peripheral edge 23*b* acts as a partition 23*a* that divides the pump chamber 25 from the operating chamber 26. When this partition 23*a* deforms toward the pump chamber 25 or the operating chamber 26, the resist liquid R is sucked in or discharged. When the diaphragm 23 is manufactured, the partition 23*a*, which is located inside the peripheral edge 23*b*, ends up being formed curved in a slightly convex shape toward either the pump chamber or the operating chamber 26. (Although FIG. 2 shows a linear diaphragm, it is actually curved in a slightly convex shape.) Consequently, in its natural state, the diaphragm 23 does not have any tensile force (or has only a small amount of tensile force) between the position at which the diaphragm curves toward the operating chamber and the position at which the diaphragm curves toward the pump chamber.

Figure 5:
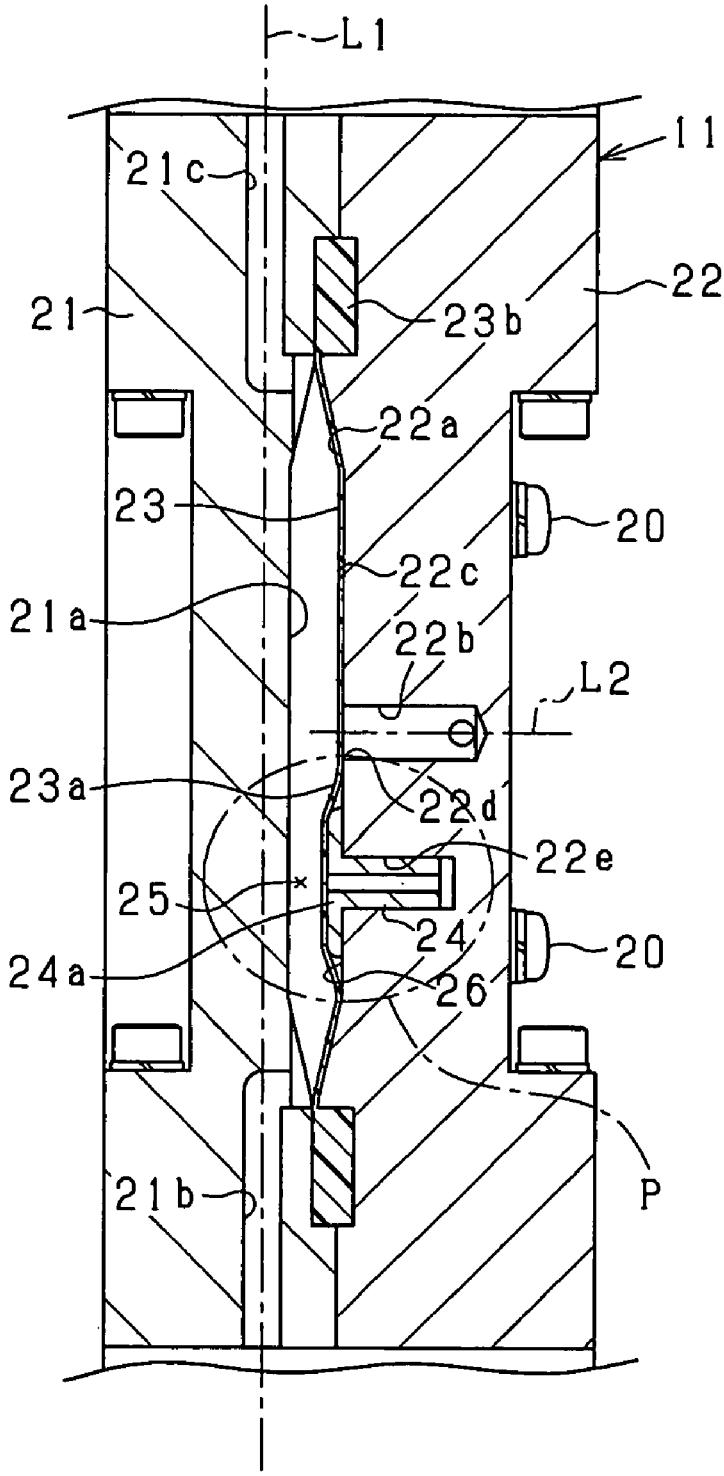
FIG. 5 is a diagram for explaining the operation of the diaphragm.

Furthermore, during suctioning of the resist liquid R, the partition 23*a* of the diaphragm 23 deforms to the position at which it contacts the internal wall surface 22*c* of the operating chamber 26, as shown in FIG. 5. In this case, the area of the partition 23*a* of the diaphragm 23 that corresponds to the pin 24 rides on the head 24*a* of the pin 24, and this area becomes curved in a slightly convex shape toward the pump chamber 25. Then, during the discharging of the resist liquid R, when the operating air is supplied from the opening 22*d* of the supply/withdrawal passage 22*b* into the operating chamber 26, deformation begins first from the area of the diaphragm 23 that rides the pin 24 (an area that is offset from the center), and as the deformation spreads to the surrounding area, the slight deformation that may start from the center, if it occurs, can be absorbed. In other words, the partition 23*a* of the diaphragm 23 is designed not to deform (invert) all at once toward the boundary of the region where tensile force does not occur (the boundary on the pump chamber 25 side). Consequently, the operating pressure applied to the diaphragm 23 changes gradually, and there is neither a sudden increase in the volume of the operating chamber 26 nor an associated rapid pressure drop, and the distance by which the diaphragm 23 is pulled back toward the operating chamber 26 becomes extremely small. As a result, the pulsation of the discharging pressure is reduced, and the discharging of the resist liquid R becomes stable. Moreover, since the change in the operating pressure applied to the diaphragm 23 is gradual, it becomes possible to precisely control the discharging pressure.

A rod-shaped, suction-side passage member 17 is secured to the center of the bottom of the pump housings 21 and 22. The suction-side passage member 17 is disposed along the flat direction of the pump 11. A suction passage 17*a*, which extends nearly linearly downward, is formed in the suction-side passage member 17. This suction passage 17*a* is disposed on the same line L1 as the suction passage 21 b of the pump 11. On the surface of the suction-side passage member 17 where it faces pump housing 21, a concave housing section 17*b* is formed around the suction passage 17*a*, and the seal ring 33 is housed inside the concave housing section 17*b*. The seal ring 33 is disposed between the suction-side passage member 17 and pump housing 21, preventing the resist liquid R inside the suction passages 17*a* and 21*b* from leaking out of the gap between the suction-side passage member 17 and pump housing 21.

The inner peripheral surface 33*a* of the seal ring 33 is smoothly continuous with the inner peripheral surfaces of the suction passages 17*a* and 21*b*. Specifically, the seal ring 33 has a shape in which the inner peripheral surface 33*a* is continuous with the inner peripheral surfaces of the suction passages 17*a* and 21*b*, and in which the concave area gradually deepens toward the outside in the radial direction as the distance from the internal passages 17*a* or 21*b* toward the center of the seal ring 33 in its thickness direction increases. In other words, this shape allows the resist liquid R to flow smoothly in the seal ring 33 area, preventing the resist liquid R and air bubbles from becoming trapped. Note that using an ordinary seal ring (O-ring) having a circular cross section creates an acute-angled dip between the seal ring and suction passages 17*a* and 21*b*. This results in a shape that is not smoothly continuous with the inner peripheral surfaces of the passages 17*a* and 21*b*, and causes the resist liquid R and air bubbles to problematically become trapped in this area. Additionally, as shown in FIG. 3, the suction-side passage member 17, using a coupling 19 provided at its tip, is connected to one end of a suction tube 31, while the other end of the suction tube 31 is guided into the resist liquid R contained inside a resist bottle 30.

The suction-side shut-off valve 13 consisting of an air-operated valve is assembled together with the suction-side passage member 17. The suction-side shut-off valve 13 has a nearly square prism shape, and is disposed in the direction perpendicular to the suction-side passage member 17 and along the flat direction of the pump 11 (pump housings 21 and 22). Here, as shown in FIG. 3, the suction-side shut-off valve 13 switches between opening and closing the suction passage 17*a* based on the switching action of an electro-pneumatic regulator 32 that is controlled by the controller 50. That is, the suction-side shut-off valve 13 has the structure shown in FIG. 1. When its supply/withdrawal chamber 13*a* is opened to the atmosphere by the switching action of the electro-pneumatic regulator 32, the valve body 13*b* of the suction-side shut-off valve 13 receives a spring force from a spring 13*c* and shuts off the suction passage 17*a*; when operating air is supplied to the supply/withdrawal chamber 13*a* from the supply source 29*a*, the valve body 13*b* sinks by working against the spring force of the spring 13*c* to open the suction passage 17*a*. Note that the part of the suction passage 17*a* near the valve body 13*b* is bent perpendicularly to the degree necessary for ensuring the reliable opening and closing action of the valve body 13*b* (roughly equaling the width of the passage). However, this bend does not significantly impact (create resistance to) the flow of the resist liquid R inside the passage member 17, but allows the resist liquid R to flow smoothly in this area as well.

The rod-shaped, discharge-side passage member 18 is secured to the center of the top of the pump housings 21 and 22. The discharge-side passage member 18 is disposed along the flat direction of the pump 11. The discharge passage 18*a*, which extends nearly linearly upward, is formed in the discharge-side passage member 18. This discharge passage 18*a* is disposed on the same line L1 as the discharge passage 21*c* of the pump 11. On the surface of the discharge-side passage member 18 where it faces pump housing 21, a concave housing section 18*b* is formed around the discharge passage 18*a*, with a seal ring 34 housed inside the concave housing section 18*b*. The seal ring 34 is disposed between the discharge-side passage member 18 and pump housing 21, preventing the resist liquid R inside the discharge passages 18*a* and 21*c* from leaking out of the gap between the discharge-side passage member 18 and pump housing 21.

Like the aforementioned seal ring 33, the inner peripheral surface 34*a* of seal ring 34 is smoothly continuous with the inner peripheral surfaces of the discharge passages 18*a* and 21*c*, resulting in a structure that prevents the resist liquid R and air bubbles from becoming trapped. Additionally, as shown in FIG. 3, the discharge-side passage member 18, through use of a coupling 19*b* provided at its tip, is connected to one end of a discharge tube 35 having a nozzle 35*a* on its other end. The nozzle 35*a* is orientated downward and disposed in a position that allows it to drip the resist liquid R onto the center of a semiconductor wafer 37 that is placed on and spins with a spinning platform 36.

A discharge-side shut-off valve 14 consisting of an air-operated valve is assembled together with the discharge-side passage member 18. The discharge-side shut-off valve 14 has a nearly square prism shape, and is disposed in the direction perpendicular to the discharge-side passage member 18, along the flat direction of the pump 11 (pump housings 21 and 22). Here, as shown in FIG. 3, the discharge-side shut-off valve 14 is constructed in the same way as the aforementioned suction-side shut-off valve 13 and switches between opening and closing the discharge passage 18*a* based on the switching action of an electro-pneumatic regulator 38 that is controlled by the controller 50. That is, the discharge-side shut-off valve 14 has the structure shown in FIG. 1. When its supply/withdrawal chamber 14*a* is opened to the atmosphere by the switching action of the electro-pneumatic regulator 38, the valve body 14*b* of the discharge-side shut-off valve 14 receives a spring force from a spring 14*c* and shuts off the discharge passage 18*a*; when operating air is supplied to the supply/withdrawal chamber 14*a* from the supply source 29*a*, the valve body 14*b* sinks by working against the spring force of the spring 14*c* to open the discharge passage 18*a*. Note that the part of the discharge passage 18*a* near the valve body 14*b* is bent perpendicularly to the degree necessary for ensuring the reliable opening and closing action of the valve body 14*b* (roughly equaling the width of the passage). However, this bend does not significantly impact (create resistance to) the flow of the resist liquid R inside the passage member 18, but allows the resist liquid R to flow smoothly in this area as well.

The suckback valve 15 consisting of an air-operated valve is assembled together with the discharge-side passage member 18, next to and on the downstream side of the discharge-side shut-off valve 14. The suckback valve 15 also has a nearly square prism shape, and is disposed in the direction perpendicular to the discharge-side passage member 18, along the flat direction of the pump 11 (pump housings 21 and 22). Here, as shown in FIG. 3, the suckback valve 15 is designed to suck back a predetermined amount of the resist liquid R located downstream of the valve 15 to the upstream side to prevent unintended dripping of the resist liquid R from the nozzle 35*a*, based on the switching actions of an electro-pneumatic regulator 39. That is, the suckback valve 15 has the structure shown in FIG. 1. When its supply/withdrawal chamber 15*a* is opened to the atmosphere by the switching action of the electro-pneumatic regulator 39, a valve body 15*b* of the suckback valve 15 sinks by receiving a spring force from a spring 15*c* and enlarges the volume of the volume-expansion chamber 18*c* connected in communication with the discharge passage 18*a*, sucking in the predetermined amount of the resist liquid R into the volume-expansion chamber 18*c*. In contrast, when operating air is supplied to the supply/withdrawal chamber 15*a* from the supply source 29, the valve body 15*b* protrudes by working against the spring force of the spring 15*c*, reducing the volume of the volume-expansion chamber 18*c* provided in the discharge passage 18*a*.

Furthermore, the regulator 16 having the shape of an approximate rectangular parallelepiped is secured to the discharge-side passage member 18 on the side facite from the discharge-side shut-off valve 14 and the suckback valve 15. That is, the regulator 16 is installed on the discharge-side passage member 18 along the flat direction of the pump I1. A base 41 of the regulator 16 is secured to the discharge-side passage member 18. A securing platform 42 is secured to the base 41, and the electro-pneumatic regulators 38 and 39, which switch the discharge-side shut-off valve 14 and the suckback valve 15, are secured to the securing platform 42. A cover 43 that covers the electro-pneumatic regulators 38 and 39 is installed on this securing platform 42. Furthermore, communication passages 45 and 46, which are connected to the electro-pneumatic regulators 38 and 39, are respectively formed on the securing platform 42 and the base 41, and are respectively connected to the supply/withdrawal chamber 14*a* of the discharge-side shut-off valve 14 and the supply/withdrawal chamber 15*a* of the suckback valve 15, though not shown in the figure. Based on the control by the controller 50, the electro-pneumatic regulators 38 and 39 either supply operating air to or withdraw it from the supply/withdrawal chamber 14*a* of the discharge-side shut-off valve 14 and the supply/withdrawal chamber 15*a* of the suckback valve 15, thereby operating the discharge-side shut-off valve 14 and the suckback valve 15.

In the pump unit 10 thus configured, the suction passage 17*a* inside the suction-side passage member 17, the suction passage 21*b* and the discharge passage 21*c* inside the pump 11, and the discharge passage 18*a* of the discharge-side passage member 18, through all of which the resist liquid R passes, are all linear in shape and disposed on the same line L1. That is, the structure of this pump unit 10 allows the length of the resist liquid R passage to be hort as much as possible, while nearly eliminating areas inside the resist liquid R passage where the resist liquid R or air bubbles could become trapped. The structure of the seal rings 33 and 34 also nearly eliminates areas where the resist liquid R or air bubbles could become trapped.

As shown in FIG. 3, the controller 50 controls a series of actions of the chemical liquid supply system, by controlling the electro-pneumatic regulator 27 to set the operating air supplied to the pump 11 at the predetermined pressure level, and also by controlling the solenoid switching valve 12, which switches and operates the pump 11; the electro-pneumatic regulator 32, which switches and operates the suction-side shut-off valve 13; and the electro-pneumatic regulators 38 and 39, which operate the discharge-side shut-off valve 14 and the suckback valve 15.

That is, when a command to begin the operation of the chemical liquid supply system is generated, the controller 50 first controls the electro-pneumatic regulator 32 to switch the suction-side shut-off valve 13, shutting off the suction passage 17*a*. This action cuts the pump 11 off from the resist bottle 30. The controller 50 also switches the solenoid switching valve 12 to supply operating air adjusted to the predetermined pressure to the operating chamber 26 inside the pump 11 via the supply/withdrawal passage 22*b*. This action causes the diaphragm 23 to move toward the pump chamber 25, pressurizing the resist liquid R contained inside the pump chamber 25. During this process, the discharge passage 18*a* is shut off by the discharge-side shut-off valve 14 on the downstream side of the pump 11, preventing discharge of the resist liquid R.

Next, the controller 50 controls the electro-pneumatic regulator 38 to switch the discharge-side shut-off valve 14, opening the discharge passage 18*a*, and also controls the electro-pneumatic regulator 39 to cancel the sucking-in of the resist liquid R by the suckback valve 15. During this process, the resist liquid R inside the pump chamber 25, pressurized by the diaphragm 23, is discharged from the pump 11, and a predetermined amount of this resist liquid R is dripped onto a semiconductor wafer from the nozzle 35*a* at the tip of the discharge pipe 35 via the discharge passage 18*a*. During this discharging operation, since the opening 22*d* of the supply/withdrawal passage 22*b* for supplying operating air is provided in the center of the internal wall surface 22*c* of the operating chamber 26 and the pin 24 is installed at a position that is offset from the center as described above, the change in the operating pressure applied to the diaphragm 23 is gradual. Consequently, there is neither a sudden increase in the volume of the operating chamber 26 nor an associated rapid pressure drop, and the distance by which the diaphragm 23 is pulled back toward the operating chamber 26 becomes extremely small. As a result, the pulsation of the discharging pressure is reduced, and the discharging of the resist liquid R becomes stable. Moreover, since the change in the operating pressure applied to the diaphragm 23 is gradual, it becomes possible to precisely control the discharging pressure.

Next, the controller 50 controls the electro-pneumatic regulator 38 to switch the discharge-side shut-off valve 14, shutting off the discharge passage 18*a*. This action stops the discharge of the resist liquid R from the nozzle 35*a*. The controller 50 also controls the electro-pneumatic regulator 39 to cause the suckback valve 15 to draw in a predetermined amount of the resist liquid R, preventing unintended dripping of the resist liquid R from the nozzle 35*a*.

Next, the controller 50 controls the electro-pneumatic regulator 32 to switch the suction-side shut-off valve 13, opening the suction passage 17*a*. This action connects the pump 11 to the resist bottle 30. The controller 50 also switches the solenoid switching valve 12, causing the operating air to be suctioned from the operating chamber 26 by means of the vacuum generation source 29*b*. Then, the pressure inside the operating chamber 26 becomes negative, with the result that the diaphragm 23 deforms to its maximum deformation position to contact the internal wall surface 22*c* of the operating chamber 26 and the resist liquid R is suctioned into and fills the pump chamber 25. From this point on, the controller 50 repeats the aforementioned actions such that a predetermined amount of resist liquid R is dripped onto each semiconductor wafer 37, as they are carried in one after another.

Next, the characteristic effects of such an embodiment are described.

In the present embodiment, the opening 22*d* of the supply/withdrawal passage 22*b* is provided in the center of the internal wall surface 22*c* of the operating chamber 26 (concave area 22*a*), and the pin 24, which protrudes toward the diaphragm 23, is installed at a position that is offset from the center of the internal wall surface 22*c*. Therefore, during suctioning of the resist liquid R, when the operating air inside the operating chamber 26 is sucked out and the diaphragm 23 deforms toward the operating chamber 26, the part of the diaphragm 23 corresponding to the pin 24 rides on the pin 24 and the diaphragm 23 becomes curved in a slightly convex shape toward the pump chamber 25. Then, during discharging of the resist liquid R, when the operating air is supplied from the opening 22*d* of the supply/withdrawal passage 22*b* into the operating chamber 26, the diaphragm 23 begins to deform first from the area that is riding on the pin 24 (the area that is offset from the center) and thus the diaphragm 23 does not deform (invert) all at once. Consequently, there is neither a sudden increase in the volume of the operating chamber 26 nor an associated rapid pressure drop, and the distance by which the diaphragm 23 is pulled back toward the operating chamber 26 becomes extremely small. As a result, the pulsation of the discharging pressure is reduced, and the discharging of the resist liquid R becomes stable. Moreover, since the change in the operating pressure applied to the diaphragm 23 is gradual, it becomes possible to precisely control the discharging pressure.

In the present embodiment, a protruding area comprised of the pin 24 is provided on the internal wall surface 22*c* of the operating chamber 26. However, it is also possible to provide a protruding area on the internal wall surface of the pump chamber 25 in a position that is offset from its center and configured such that the protruding area contacts the diaphragm 23 before the diaphragm 23 deforms toward the boundary of the region where tensile force does not occur (the boundary on the pump chamber 25 side). With such a configuration, the deformation is gradually suppressed from the position that is offset from the center of the diaphragm 23. Therefore, as with the chemical liquid supply pump described above, the change in the operating pressure applied to the diaphragm 23 becomes gradual. However, providing a protruding area in the pump chamber 25 would not be desirable since it would not only interfere with the flow of the resist liquid R, but could also cause stagnation in the resist liquid R. Therefore, it is desirable to provide the protruding area (pin 24) on the internal wall surface 22*c* of the operating chamber 26 as in the present embodiment.

In the present embodiment, the installation hole 22*e* for installing the pin 24 is formed on the internal wall surface 22*c* of the operating chamber 26. That is, only the installation hole 22*e* need be formed on the internal wall surface 22*c* of the operating chamber 26. Therefore, forming the internal wall surface 22*c* of the operating chamber 26 is simpler, especially when machining is used to form the operating chamber 26, than integrally forming the protruding area corresponding to the pin 24 with the internal wall surface 22*c*.

In the present embodiment, the protrusion height of the pin 24 (head 24*a*) from the internal wall surface 22*c* of the operating chamber 26 is set to be smaller than the distance from the internal wall surface 22*c* to the midpoint between the operating chamber 26 and the pump chamber 25. As a result, this pin 24 does not significantly interfere with the flow of the resist liquid R inside the pump chamber 25.

In the present embodiment, the fact that the internal wall surface 22*c* of the operating chamber 26 is circular in shape and the opening 22*d* of the supply/withdrawal passage 22*b* is positioned in the center of the circular internal wall surface 22*c*, allows the operating air to be efficiently supplied to or withdrawn from the operating chamber 26.

In the present embodiment, since the pump housing 22 is formed to be thin in the deformation direction of the diaphragm 23 in order to reduce the thickness of the pump 11, the operating chamber 26 must also be formed to be thin in the same direction. During the suctioning of the resist liquid R, the diaphragm 23 is usually used in contact with the internal wall surface 22*c* of the operating chamber 26 in order to maximize the volume of the resist liquid R to be suctioned, which becomes one of the factors that cause the entire partition 23*a* of the diaphragm 23 to deform all at once during the discharging of the resist liquid R. Therefore, the significance of making the diaphragm 23 gradually deform from a position that is offset from its center is great.

Note that the present invention is not limited to the described contents of the aforementioned embodiment and may be implemented in other ways, as in the following examples.

Figure 6:
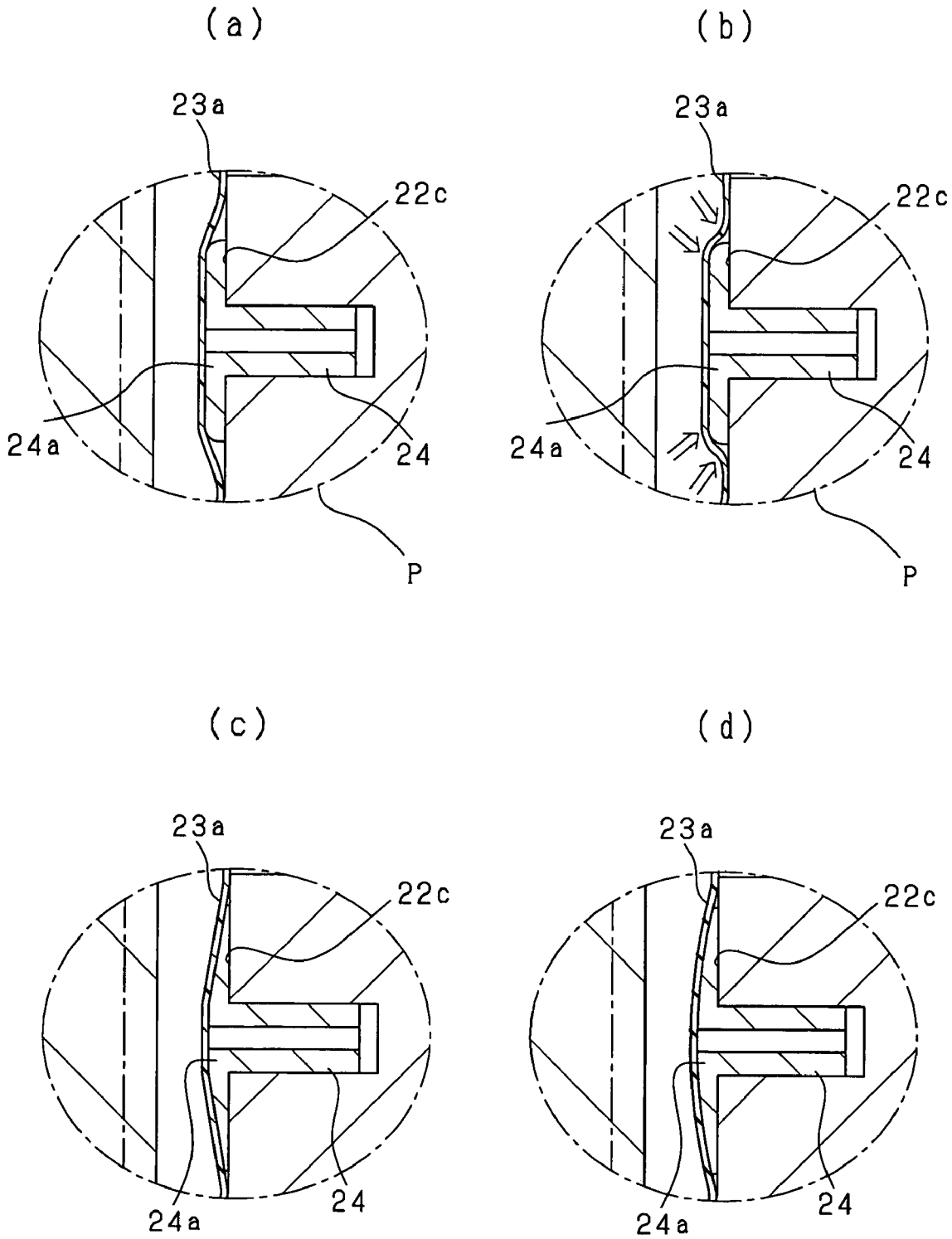
FIG. 6(*a*) is a magnified view of the area p in FIG. 5; (*b*) is a diagram illustrating a case in which (*a*) has deformed to the maximum deformation position; (*c*) is a magnified cross-sectional diagram of a pin in anther example; and (*d*) is a magnified cross-sectional diagram of a pin in still anther example.

In the aforementioned embodiment, the head 24*a* of the pin 24 has a disk shape. FIG. 6 (*a*) is a magnified view of the area p of the embodiment in FIG. 5, and (*b*) illustrates a case in which the partition 23*a* of the diaphragm 23 in (*a*) has deformed to the maximum deformation position to contact the internal wall surface 22*c* of the operating chamber 26. As is clear from these figures, the protrusion height of the periphery of the top surface of the head 24*a* of the pin 24 from the internal wall surface 22*c* is relatively large, leaving a gap between the periphery of the top surface and the internal wall surface 22*c*. Consequently, the partition 23*a* of the diaphragm 23 is deeply bent at the boundary of this gap, i.e., the periphery of the top surface of the head 24*a* of the pin 24, and in the vicinity of the area where the head 24*a* of the pin 24 begins to protrude from the internal wall surface 22*c* (area indicated by the arrows in the figure), concentrating the stress in these areas. When this state of concentrated stress is repeated through the discharging and suctioning actions of the pump 11, the density of the diaphragm 23 in the bent area gradually decreases, making it easier for the resist liquid R to penetrate the diaphragm 23, creating the risk that it may eventually leak into the operating chamber 26.

To prevent such a problem, it is possible to shape the head 24*a* of the pin 24 such that its protrusion height decreases continuously toward its periphery. Specifically, the head 24*a* of the pin 24 could have a compressed shape that gradually slopes at a given angle toward the periphery and the internal wall surface 22*c* as shown in FIG. 6 (*c*), or a slightly convex, curved shape that gradually slopes toward the periphery and the internal wall surface 22*c* as shown in FIG. 6 (*d*). With such a shape, the protrusion height of the head 24*a* of the pin 24 does not change drastically anywhere on its top surface, and the gap between the periphery of the top surface and the internal wall surface 22*c* narrows. As a result, even when the partition 23*a* of the diaphragm 23 deforms to contact the internal wall surface 22*c* of the operating chamber 26, it will not bend significantly in any particular area and the stress will be distributed evenly, thus preventing damage to the diaphragm 23 due to stress concentration.

Figure 7:
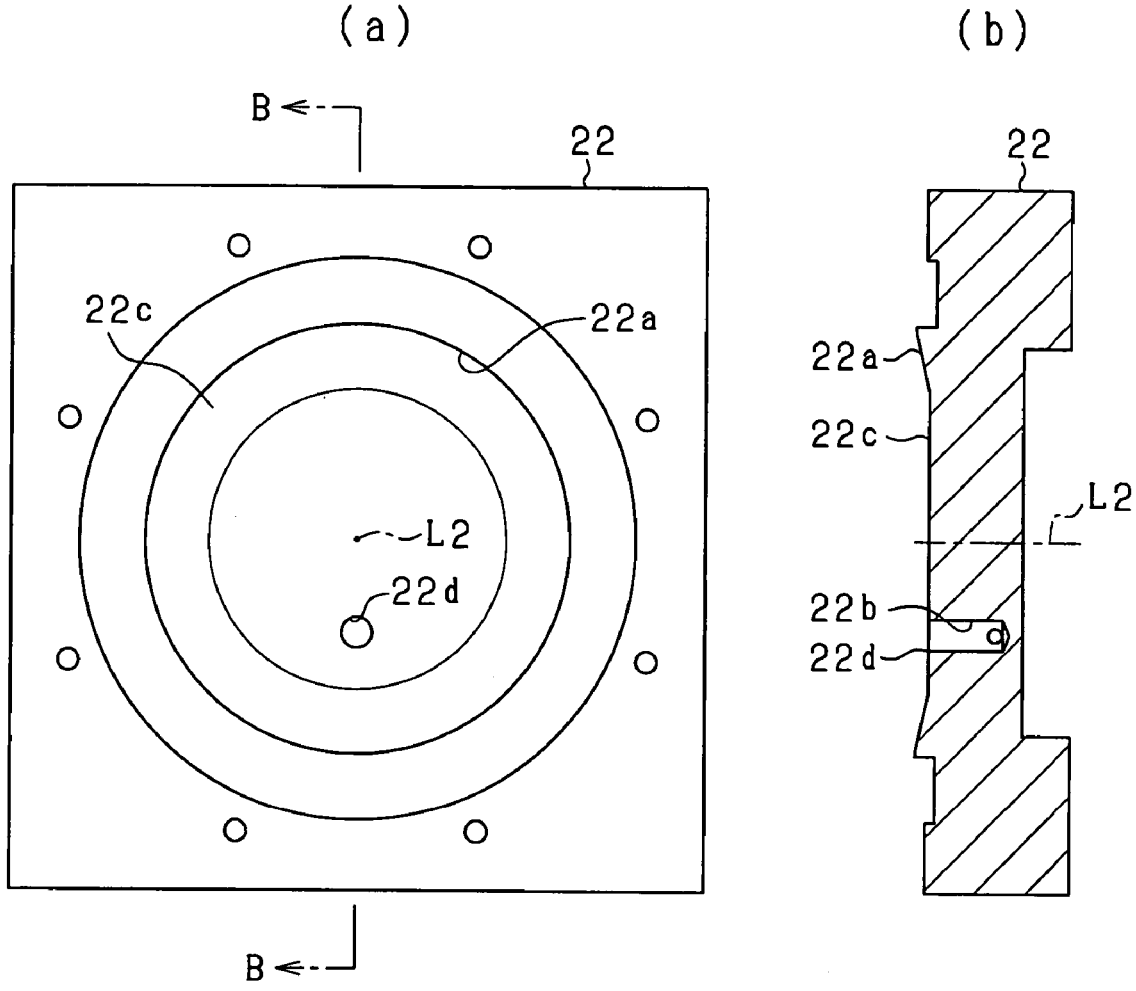
FIG. 7(*a*) is the front view of the pump housing on the operating chamber side in another example, and (*b*) is a cross-sectional diagram along line B-B in (*a*).

In the aforementioned embodiment, the opening 22*d* of the supply/withdrawal passage 22*b* is provided at the center of the internal wall surface 22*c* of the operating chamber 26 and the pin 24 is installed in a position that is offset from the center, to prevent the pulsation of the discharging pressure caused by the diaphragm 23. Instead, it is also possible to provide the opening 22*d* of the supply/withdrawal passage 22*b* in a position that is offset from the center of the internal wall surface 22*c* of the operating chamber 26 without using the pin 24, as shown in FIG. 7.

Figure 8:
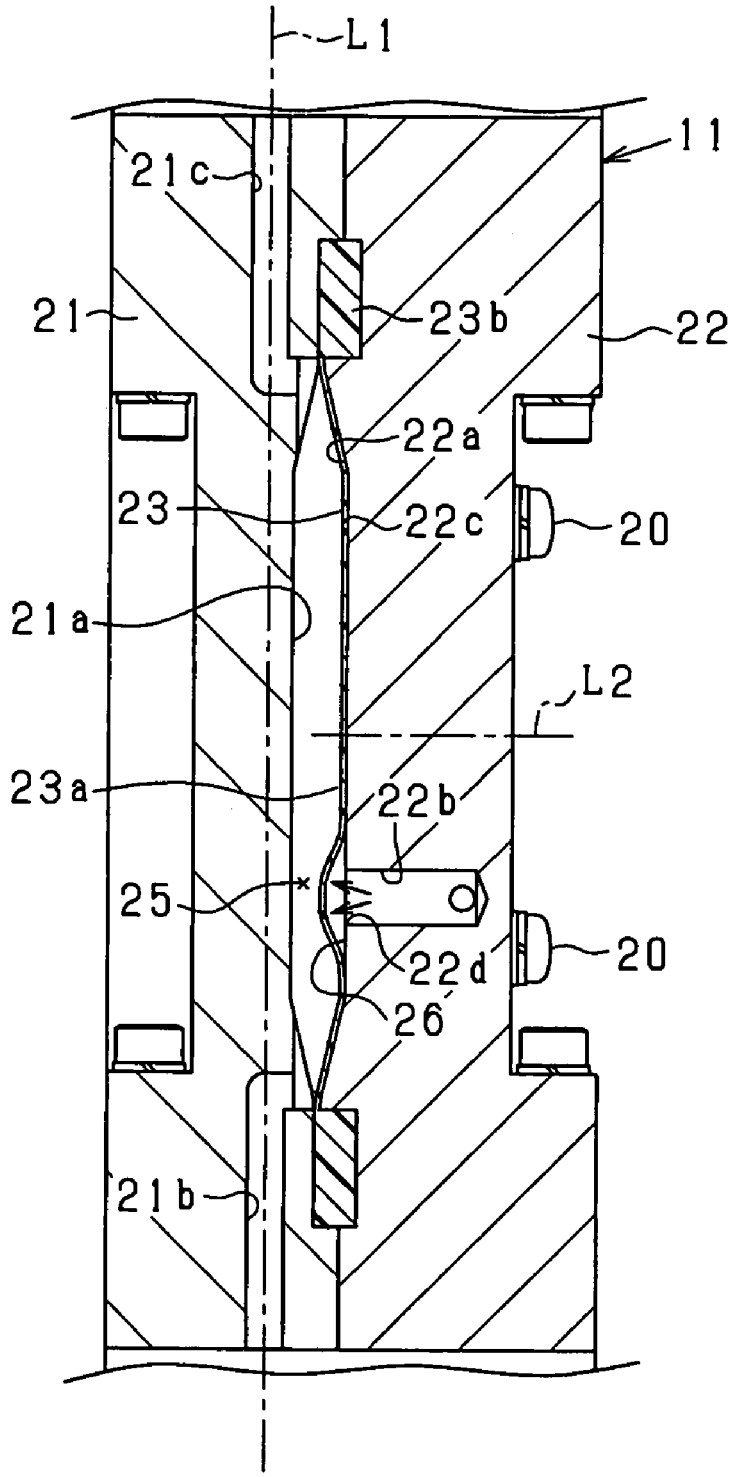
FIG. 8 is a diagram for explaining the operation of the diaphragm in another example.

With such a configuration, during discharging of the resist liquid R, when the operating air is supplied from the opening 22*d* of the supply/withdrawal passage 22*b* into the operating chamber 26, the part of the diaphragm 23 that corresponds to the opening 22*d* begins to deform first since the opening 22*d* is offset from the center of the internal wall surface 22*c*, as shown in FIG. 8. Consequently, as in the aforementioned embodiment, the partition 23*a* of the diaphragm 23 does not deform (invert) toward the boundary of the region where tensile force does not occur (the boundary on the pump chamber side) all at once, and thus the operating pressure applied to the diaphragm 23 changes (increases) gradually. Therefore, in the present embodiment as well, there is neither a sudden increase in the volume of the operating chamber 26 nor an associated rapid pressure drop, reducing the pulsation of the discharging pressure caused by the diaphragm 23, and thus stabilizing the discharging of the resist liquid R. Moreover, since the change in the operating pressure applied to the diaphragm 23 is gradual, it becomes possible to precisely control the discharging pressure.

Figure 9:
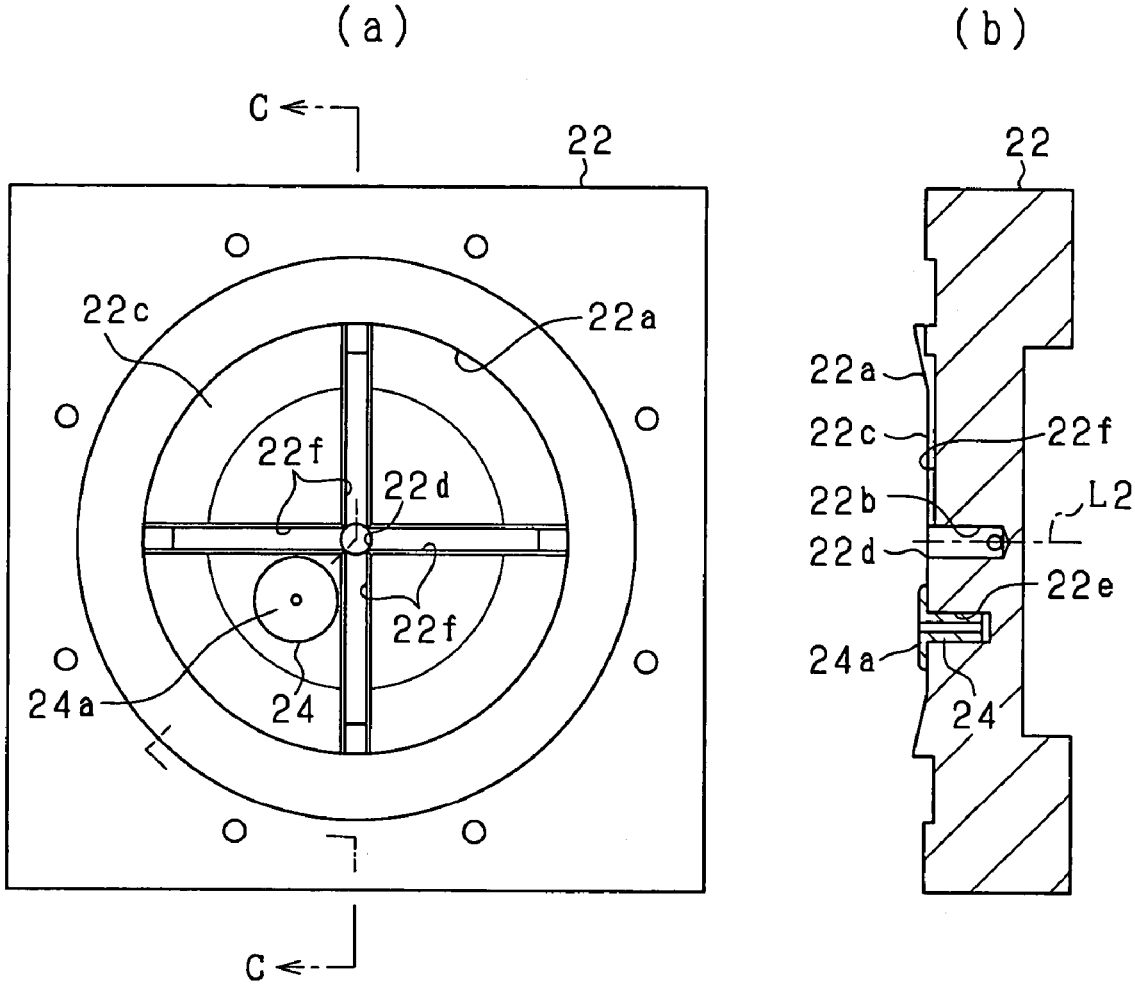
FIG. 9(*a*) is the front view of the pump housing on the operating chamber side in another example, and (*b*) is a cross-sectional diagram along line C-C in (*a*).

In the aforementioned embodiment, it is also possible to form on the internal wall surface 22*c* of the operating chamber 26, for example, a cross-shaped venting groove 22*f* that is linked to the opening 22*d* of the supply/withdrawal passage 22*b* and extends (expands) to the periphery of the operating chamber 26, as shown in FIG. 9.

Figure 10:
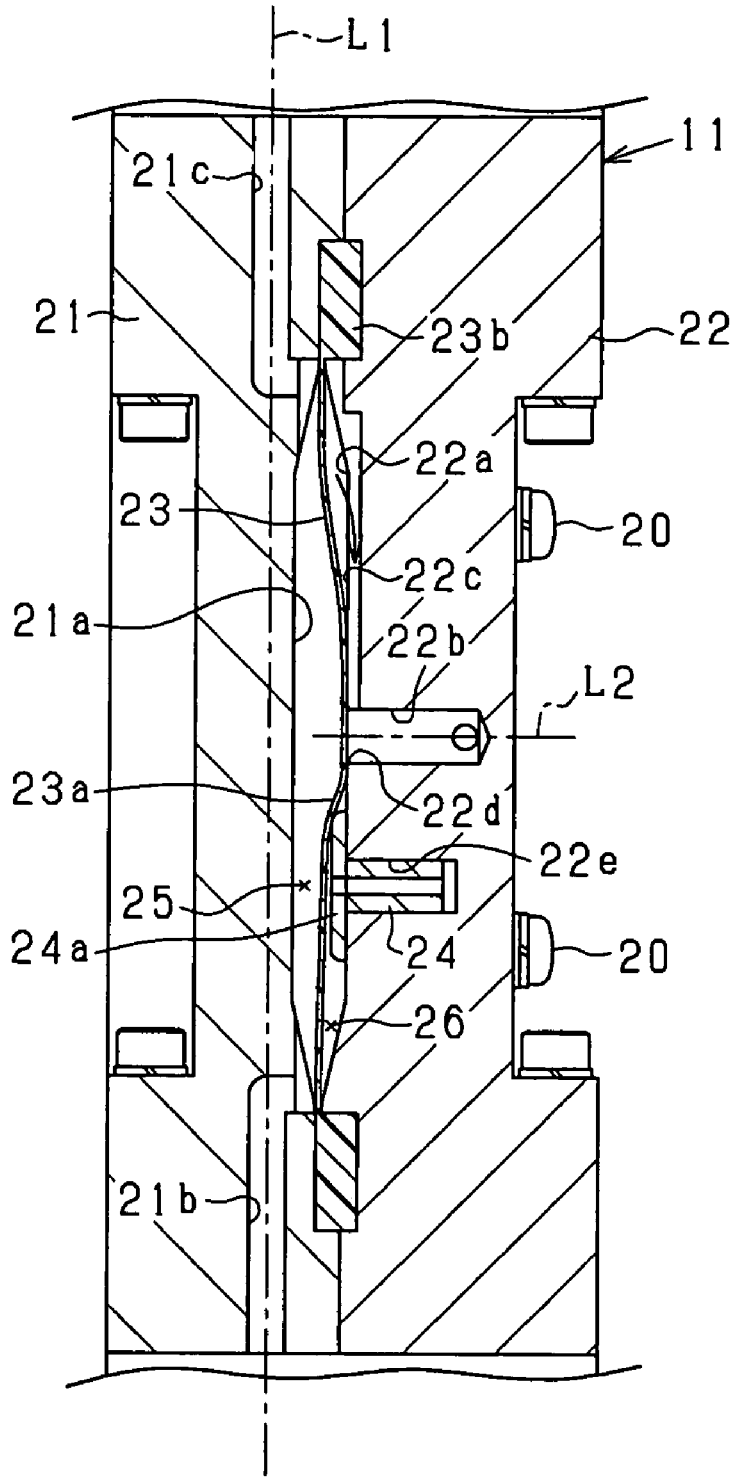
FIG. 10 is a diagram for explaining the operation of the diaphragm in another example.

The operating chamber 26 is formed to be thin in the deformation direction of the diaphragm 23. Therefore, during suctioning of the resist liquid R, the center of the diaphragm 23, which is in the form of a film, tends to cover the opening 22*d* of the supply/withdrawal passage 22*b* first, as shown in FIG. 10. Consequently, when such an event occurs, since the opening 22*d* of the supply/withdrawal passage 22*b* is connected to the venting groove 22*f*, which extends to the periphery, the operating chamber 26 continues to be evacuated through the venting groove 22*f* positioned on the outside of the center contacted first (the flow of the operating air is indicated by the arrow in FIG. 10). This allows the diaphragm 23 to sufficiently deform toward the operating chamber 26 within a short period, thus shortening the time needed for filling the pump chamber 25 with the resist liquid R and ensuring a sufficient charging volume.

Note that the shape of the venting groove is not limited to such a shape. When using other shapes, it is desirable to position the venting groove as close as possible to the periphery of the operating chamber 26, and it is best to extend the venting groove to the periphery of the operating chamber 26 as described above.

It is also possible to form the entire internal wall surface 22*c* of the operating chamber 26 as a rough surface, configuring the venting groove with continuous individual concave areas obtained by roughening the surface. Note that the internal wall surface 22*c* can be easily roughened by means of shot blasting, that is, by blasting the surface with abrasive grains.

In the aforementioned embodiments, the pressure inside the operating chamber 26 is set to be negative during suctioning of the resist liquid R. However, the operating chamber 26 can also be opened to the surrounding atmosphere. In this case, the interior of the resist bottle 30, for example, must be pressurized.

In the aforementioned embodiments, the pump unit 10 is comprised of the pump 11, which acts as a pump for supplying chemical liquids and into which shut-off valves 13 and 14, the suckback valve 15, or the like are integrated. However, other configurations that have at least the pump 11 body can also be used.

In the aforementioned embodiments, an explanation is provided using operating air as an example. However, it is also possible to use another gas such as nitrogen in place of air.

In the aforementioned embodiments, an example using the resist liquid R is described. This is because the target onto which the chemical liquid is to be dripped is assumed to be a semiconductor wafer 37. However, other chemical liquids and other chemical liquid dripping targets may also be used.

The invention claimed is:

1. A pump for supplying chemical liquids using operating gas, the pump comprising:

a pump housing having a concave chamber; and a diaphragm having a flexible film that divides the concave chamber into a pumping chamber and an operating gas chamber;

the pump housing further including:

a gas passage;

a suction passage; and a discharge passage;

the gas passage being connected to the operating gas chamber and configured to drive the flexible film with the operating gas;

the suction passage being connected to the pumping chamber and configured to suction the chemical liquids with the driven flexible film;

the discharge passage being connected to the pumping chamber and configured to discharge the chemical liquids with the driven flexible film; and the pump housing further including a stationary protruding portion positioned on a first internal concave wall surface of the operating gas chamber so that the stationary protruding portion is offset from a center of the first internal concave wall surface of the operating chamber;

the pump being configured so that:

during suctioning of the chemical liquid, operating gas inside the operating chamber is evacuated from the chamber and the flexible film deforms against the first internal concave wall surface of the operating gas chamber, and a part of the flexible film corresponding to the protruding portion rides on the protruding portion wherein the part of the flexible film riding on the protruding portion deforms in a convex shape toward the pumping chamber; and during discharging of the chemical liquid, operating gas is introduced into the operating chamber and the flexible film deforms towards the pumping chamber beginning from the part of the flexible film that is riding on the protruding portion, so that pulsations due to the drive of the flexible film are reduced; and a height of the stationary protruding portion from the first internal concave wall surface decreases continuously toward a periphery of the stationary protruding portion.

2. The pump according to claim 1, wherein:

the first internal concave wall surface has an opening of the gas passage, and the stationary protruding portion is provided at an offset position that has a larger offset than an offset of the opening of the gas passage, the offset being a distance from a center of the operating gas chamber.

3. The pump according to claim 1, wherein:

the pumping chamber has a second internal concave wall surface, and the stationary protruding portion protrudes a height from the first internal concave wall surface, the height being lower than a distance from the first internal concave wall surface to a midpoint between the first internal concave wall surface and the second internal concave wall surface.

4. The pump according to claim 1, wherein:

the first internal concave wall surface has a venting groove, the venting groove extending from the gas passage toward a periphery of the first internal concave wall surface.

5. The pump according to claim 1, wherein:

the first internal concave wall surface has a circular shape.

6. A pump for supplying chemical liquids using operating gas, the pump comprising:

a pump housing having a concave chamber; and a diaphragm having a flexible film that divides the concave chamber into a pumping chamber and an operating gas chamber;

the pump housing further including:

a gas passage;

a suction passage; and a discharge passage;

the gas passage being connected to the operating gas chamber and configured to drive the flexible film with the operating gas;

the suction passage being connected to the pumping chamber and configured to suction the chemical liquids with the driven flexible film;

the discharge passage being connected to the pumping chamber and configured to discharge the chemical liquids with the driven flexible film; and the pump housing further including a stationary protruding portion positioned on a first internal concave wall surface of the operating gas chamber so that the stationary protruding portion is offset from a center of the first internal concave wall surface of the operating chamber;

the pump being configured so that:

during suctioning of the chemical liquid, operating gas inside the operating chamber is evacuated from the chamber and the flexible film deforms against the first internal concave wall surface of the operating gas chamber, and a part of the flexible film corresponding to the protruding portion rides on the protruding portion wherein the part of the flexible film riding on the protruding portion deforms in a convex shape toward the pumping chamber; and during discharging of the chemical liquid, operating gas is introduced into the operating chamber and the flexible film deforms towards the pumping chamber beginning from the part of the flexible film that is riding on the protruding portion, so that pulsations due to the drive of the flexible film are reduced; and the stationary protruding portion is installed in an installation hole in the first internal concave wall surface.

* * * * *